United States Patent [19]

van Haaften

[11] 4,066,014

[45] Jan. 3, 1978

[54] PRESSURIZED INK APPLICATOR FOR INTAGLIO PRINTING PRESS

[75] Inventor: Peter van Haaften, Ottawa, Canada

[73] Assignee: American Bank Note Company, New York, N.Y.

[21] Appl. No.: 646,493

[22] Filed: Jan. 5, 1976

Related U.S. Application Data

[63] Continuation-in-part of Ser. No. 479,898, June 17, 1974, abandoned.

[51] Int. Cl.[2] ..... B41F 9/10; B41F 31/08

[52] U.S. Cl. ..... 101/157; 101/366

[58] Field of Search ..... 101/366, 157, 169, 350, 101/365; 118/261, 266, 259

[56] References Cited

U.S. PATENT DOCUMENTS

| | | | |
|---|---|---|---|
| 1,566,358 | 12/1925 | White | 101/169 X |
| 2,151,968 | 3/1939 | Henderson | 101/157 |
| 2,151,969 | 3/1939 | Henderson | 101/157 |
| 2,168,229 | 8/1939 | MacArthur | 101/181 |
| 2,177,656 | 10/1939 | Kaddeland | 101/157 |
| 2,226,311 | 12/1940 | Klingler | 101/157 |
| 2,278,387 | 3/1942 | Wickwire, Jr. | 101/157 |
| 2,377,482 | 6/1945 | Crafts | 101/157 |
| 2,404,689 | 7/1946 | Carlsen et al. | 101/169 |
| 2,655,102 | 10/1953 | Ross | 101/157 |
| 3,134,326 | 5/1964 | Davis | 101/366 |
| 3,186,335 | 6/1965 | Gaulin | 101/157 |
| 3,630,146 | 12/1971 | Shields | 101/169 |

FOREIGN PATENT DOCUMENTS

| | | | |
|---|---|---|---|
| 1,097,295 | 7/1955 | France | 101/157 |
| 1,100,041 | 2/1961 | Germany | 101/366 |

*Primary Examiner*—J. Reed Fisher

*Attorney, Agent, or Firm*—Cooper, Dunham, Clark, Griffin & Moran

[57] ABSTRACT

A pressurized ink applicator for an intaglio printing press using viscous stiff-bodied ink is provided with an ink-shearing element or heating element within the applicator nozzle to apply energy to the ink thereby to improve its flow properties immediately before its application to the printing plate of the press. A tight seal between the nozzle and the printing plate is provided by spaced blades resiliently mounted in the nozzle. Ink is forced by air pressure from an ink container into the nozzle. A distributing manifold is provided in the flow path from a plurality of ink containers to the nozzle immediately before multiple parallel restrictions in the ink flow path. An optional sliding valve operating transversely in relation to the ink flow path controllably cuts off the flow of ink, as for example when gaps between printing plate edges pass by the nozzle. The sliding valve is controlled by a cam moving with the printing plate. The valve operates between gates having mutually offset openings so that ink flow pressure is borne by the gates rather than by the sliding valve.

21 Claims, 24 Drawing Figures

PRESSURIZED INK APPLICATOR FOR INTAGLIO PRINTING PRESS

The present patent application relates to a pressurized stiff-bodied ink applicator for an intaglio printing press, and is a continuation-in-part of application Ser. No. 479,898, now abandoned, filed June 17, 1974.

BACKGROUND OF THE INVENTION

Intaglio printing using stiff-bodied inks for the printing of artistic works and securities differs substantially from other common printing techniques (letterpress, rotogravure and offset) in a number of fundamental ways. Hereinafter such intaglio printing using stiff-bodies inks will be referred to as "intaglio security printing", with the understanding that the term applies also to the printing of artistic works by means of the same technique. Tonal effects are created in intaglio security printing by varying the spacing, area and depth of engraved ink-receiving recesses on the printing plate. Frequently the engraving is done by hand by skilled artisans who use line lengths, line thicknesses, line spacings and the angles between lines etc., to achieve a tonal effect on the printed document. The resulting product is characterized by a distinct embossment of the printed surface, readily sensed by touch, and characterized by absolute registration of the printing with the embossing. The intaglio security printing technique requires a substantial range of widths and depths of engraved recesses, and thus requires a stiff-bodied ink and very high printing pressures in order to obtain the desired results. Conventionally, the stiff-bodied inks used have thixotropic properties.

For the foregoing reasons, and for the additional reason that intaglio security printing requires the very highest quality and consistency of quality, intaglio security printing has for many decades relied upon the individual skills of engravers and printers to achieve the desired results.

Intaglio security printing can be accomplished using a die stamp press or a rolling contact press. The rotary press is more common in industrial intaglio printing applications and therefore in most of the following discussion, a rotary press context is assumed, although the discussion can be applied *mutatis mutandis* to other rolling contact presses and to die stamp presses.

Conventionally a rotary intaglio press includes an engraved cylinder having a continuous or interrupted printing surface, or a plate cylinder carrying at least one printing plate as a printing surface, on which is engraved the image desired to be printed. (In this discussion, the more common term "plate cylinder" will be used although it will be understood that the discussion can be applied *mutatis mutandis* to engraved cylinders. The "engraved areas" of the plate cylinder mean those areas occupied by the engraved recesses, and the "non-engraved areas" mean those area of the plate cylinder not so occupied, including the areas between adjacent recesses. The term "non-image areas" is used herein to refer to the macroscopic continuous non-engraved areas between leading and trailing boundaries of the image or images engraved on the plate cylinder.) An impression roller forms a nip with the plate cylinder through which the paper to be printed passes. The ink image is transferred to the paper as it passes through the nip. Ink is applied to the plate cylinder from an ink fountain (which is usually at least partially open to the atmosphere, thereby permitting evaporation of solvents and atmospheric contamination of the ink, thus leading to deterioration of desired ink qualities) via a number of ink transfer rollers the final one of which, the form roller, makes direct contact with the plate cylinder. The transfer rollers are provided to shear the thixotropic ink thereby to enable it to flow more smoothly, it being understood that the viscosity of a thixotropic ink is lowered as a result of mechanical shearing. Because in intaglio security printing the engraved recesses can be relatively deep (as much as 0.010 inch), the form roller must carry a heavy ink load. The result is that the ink is deposited indiscriminately on both engraved and non-engraved areas of the plate, at least partially filling the engraved recesses but also being deposited on the non-engraved surface of the plate cylinder on which no ink whatever is desired. In order to remove the ink from these non-engraved surface areas and in order to direct ink into the engraved recesses or remove surplus ink from the recesses so that they are filled to the desired level, a series of wiping stages are provided following the application of ink to the plate cylinder. Wiping paper or burlap or a similar material is passed over a contacting wiper pressure element which presses the wiping material against the plate cylinder so that at least some of the ink on the surface of the plate cylinder will be rubber by the wiper off the non-engraved areas of the plate and into the engraved recesses, while at the same time at least some of the ink will be removed from recesses which have been over-filled. A substantial quantity of ink is moved about on the contact of the first wiper with the plate cylinder. This first wipe is followed by at least one further polishing wipe of ensure that the non-engraved areas of the plate are clean. Intermediate wiping stages may be provided as desired.

The foregoing conventional process results in substantial waste of ink, since a lot of ink is removed from the plate by the wiping material. To circumvent this problem, a number of previous proposals for ink-saving devices have been made. Among these are friction-driven rollers in contact with the plate cylinder and located between the ink applicator rollers and the first wiper. Another technique is the use of a counter-rotating belt in contact with the plate cylinder and again located between the ink transfer rollers and the first wiper. Still other proposals include the use of scraper blades, gear-driven rollers, etc. making contact with the plate cylinder between the ink transfer rollers and the first wiper. Various techniques are employed to remove the ink from the contacting element and return it to the ink fountain. While these procedures do result in a certain ink saving, they also involve exposure of the ink to the atmosphere over an appreciable path of travel, thereby permitting unwanted evaporation of solvents. This means that the ink returned to the fountain is usually not of the desired characteristics, and adjustments have to be continually made to achieve satisfactory printing quality. Further, these ink savers do nothing to control the quantity of ink deposited in the engraved recesses — the ink is caused to flow into the recesses thoroughly to the desired levels in the wiper stages, which continue to be wasteful of ink. The conventional processes with or without ink savers remain highly dependent upon the individual skills of the printer.

SUMMARY OF THE INVENTION

It would be economical to apply to the engraved printing plate only enough ink to fill the engraved recesses without depositing any appreciable quantity of ink on the non-engraved areas. The present invention provides a pressurized ink applicator which tends to minimize the application of ink to the non-engraved areas while substantially completely filling the engraved recesses. Because the applicator operates under substantially constant pressure (as distinguished from constant displacement systems found for example in newspaper presses), uniformity of ink deposit without substantial ink waste is achieved.

The ink is applied by the applicator to the printing surface between two or more transversely extending blades biased towards engagement with the printing surface. The applicator nozzle thereby sealingly contacts the printing surface, and the trailing blade serves to doctor applied ink from the non-engraved areas of the printing surface. A resilient pad or the like permits the blades to deflect slightly to accommodate surface variations of the printing surface.

While pressurized applicators of one kind or another have been known in other printing arts, it has been the conventional wisdom in the intaglio security printing art that transfer rollers must be used to apply the ink, because the transfer rollers shear the thixotropic ink as it passes over the rollers, thereby imparting to the ink the desired low viscosity as it passes from the form roller onto the printing plate.

In the design of the ink applicator according to the present invention, it has been recognized that such applicator must be capable of applying a viscous thixotropic ink to the printing plate. According to the present invention, energy transfer means are provided in the ink applicator to transfer energy to the ink, for improving the flow characteristics of the ink immediately prior to the application of the ink to the plate cylinder. Such means may be either mechanical means for shearing the ink, or means for the application of heat to the ink, or a combination of both. Such means imparts energy to the ink e.g. by direct conduction of heat or by forcing the ink through a perforated plate, sieve or the like. The imparting of energy to a thixotropic ink reduces its viscosity and thus improves its flow characteristics.

Dilatant inks are not commonly used in intaglio printing. These inks become more viscous as they are mechanically worked. Since the pressurized ink applicator of the invention can impart a controlled amount of mechanical energy to the ink flowing from an ink reservoir through the nozzle to the printing plate, it may perhaps be possible to use dilatant inks in intaglio printing, by using the applicator of the present invention.

Again because of the viscous character of thixotropic inks, it is desirable to design the nozzle of the applicator so that the ink has an opportunity to flow completely into all of the engraved recesses; the nozzle of a preferred embodiment of the present invention makes use of two design features to achieve this objective. The first of these is the provision of distributing and collecting manifolds at strategically-chosen locations in the ink flow path to enable the ink to occupy relatively large volumes at such locations so that there is a tendency to eliminate gas or vapor bubbles (or conceivably evacuated spaces) in the ink flow path. The second of these design features is the use of the principle of redundancy; in one embodiment at least two nozzle apertures are provided to enable ink to be applied to the engraved recesses through at least two exit chambers. If by any chance there is a flow failure in one of the apertures, then the other aperture or apertures will be able to supply the ink to the engraved recesses. In this type of embodiment, the central blade may be wedge-shaped and the hydraulic load on the wedge surfaces of the central blade may be utilized to force the blade into contact with the printing surface.

In one embodiment, the blades are chosen to be of a plastic material optionally carrying an imbedded lubricant, which material is capable of some degree of transverse flexing to accommodate variations in the surface of the plate, so as to provide the required tight seal of the nozzle against the plate whilst at the same time avoiding undue wearing of the printing plate by the nozzle.

In one embodiment, the trailing blade is provided with a sloping surface inclined outwardly away from the nozzle exit towards the printing surface. This tends to facilitate complete filling of the engraved recesses.

In another embodiment, the trailing blade is a thin comb-shaped metal blade capable of flexure to accommodate variations of or irregularities on the printing surface and supported by thicker blade support elements which stabilize the blade for doctoring purposes.

A further optional feature of a preferred embodiment of the ink applicator according to the invention is the use of a valve to shut off the flow of ink to the plate (e.g. in a rotary press, where there are large gaps between imaged areas of the cylinder; or in a die stamp press, during the return stroke of the reciprocating assembly). This avoids flow of ink except onto the imaged areas of the plate. The valve is conveniently cam-controlled. In a rotary press, the cam may be fixed to and may rotate with the cylinder. As a further feature of the valve arrangement, the preferred embodiment provides a sliding valve element working between two stationary gates and adapted to slide at right angles to the general direction of ink flow. The ink flow path through the valve is arranged so that the sliding element itself is not subjected to the force load caused by ink pressure; this force is instead borne by the two stationary gates. This is accomplished in the preferred embodiment by arranging corresponding openings on the two gates to be transversely offset from one another relative to the general direction of ink flow. These features of the invention permit the valve to be opened and closed relatively rapidly without having to bear the very high loads in the general direction of ink flow imposed by the pressurized source of ink; the valve is not appreciably loaded except by the ink drag (i.e. the force of friction resulting from the viscosity of the ink).

The use of a pressurized ink applicator according to the invention, with the elimination of the conventional ink fountain and transfer rollers, minimizes ink exposure to the air — the only exposure occurs when the applicator valve shuts off the flow of ink. (In the case of a die stamp press, the ink shut-off would occur on the return motion of the reciprocating plate). The use of constant pressure and optionally, multiple ink application regions, tends to assure a complete deposit of ink into the engraved recesses on the printing plate. The use of heating or ink shearing elements in the applicator enables satisfactory ink flow to be achieved. Ink consumption will be reduced because of the absence of any appreciable ink deposit on the non-engraved portions of the plate. Since in the embodiments described the amount of ink on non-engraved areas is minimal, a smaller quantity of wiping material is needed, which enables cost savings to be made. More uniform printing quality should be obtainable, with consequent reduction of losses due to printing spoilage.

The use of the ink applicator may also increase the number of options available to printers with respect to choice of inks, since consistency of ink quality can be reasonably assured with the absence of exposure of the ink to the air. Faster drying inks, cheaper inks and conceivably dilatant inks may possibly be used in some applications. The relative absence of ink exposure to the atmosphere also implies that very little evaporation of solvents will occur, thereby improving the working environment of operating personnel.

A preferred embodiment of the invention will now be described with reference to the accompanying drawings.

DETAILED DESCRIPTION WITH REFERENCE TO DRAWINGS

Figure 1:
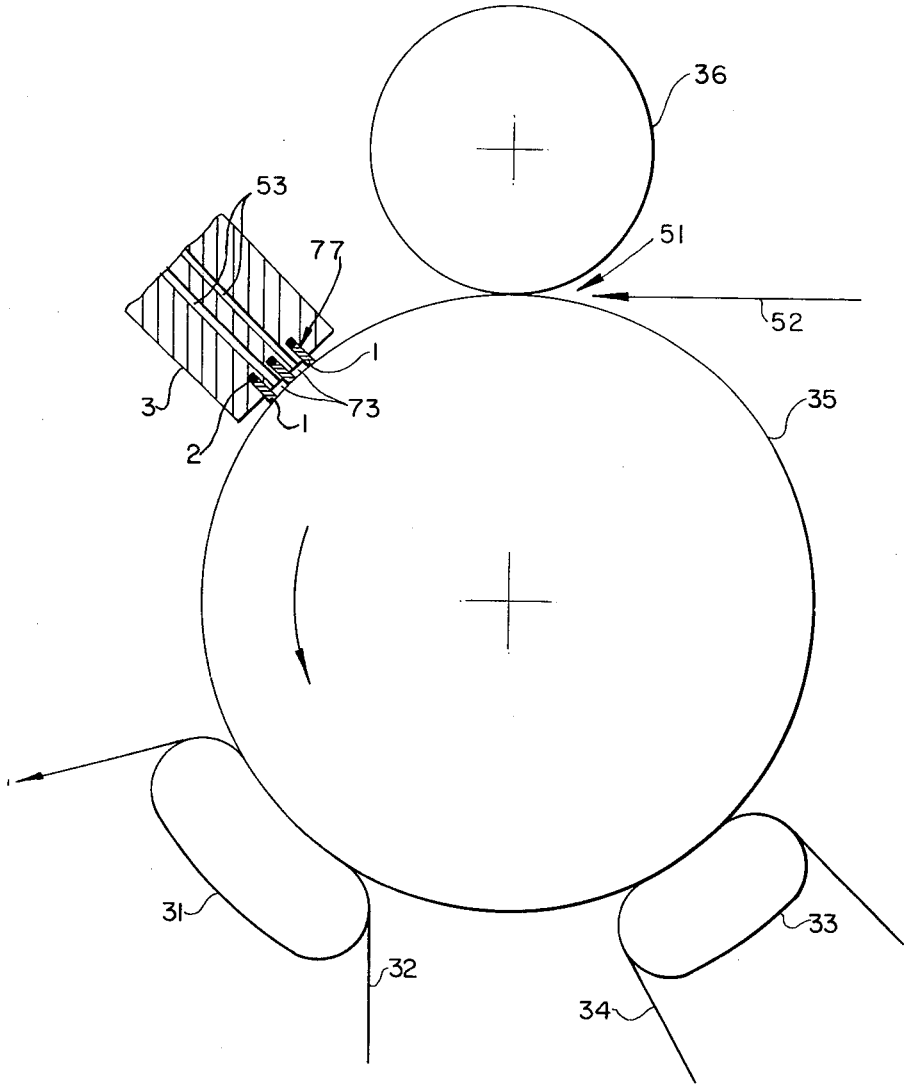
FIG. 1 is a schematic diagram showing an end view of an intaglio cylindrical printing press wherein the nozzle portion of a preferred embodiment of the ink applicator according to the present invention is shown schematically in section.

FIG. 1 portrays schematically a conventional plate cylinder 35 of an intaglio printing press forming a nip 51 with an impression roller 36 into which nip a sheet or web of paper 52 adapted to receive an ink image is fed. In the drawing, cylinder 35 is shown as rotating counter-clockwise. As the paper 52 passes through the nip 51, the ink image deposited in engraved recesses (not shown) on the printing plate of the plate cylinder 35 is transferred to the paper 52. Prior to the rotation of the image-bearing portion of the plate cylinder to the nip, the image areas of the plate have been inked, wiped and polished. In conventional intaglio printing presses, ink is applied liberally prior to the rotation of the plate under the wiper or wipers. A conventional wiper 31 is shown over which wiping paper, burlap or other suitable material 32 is passed to contact and wipe the plate. The plate is thereafter polished by a conventional polisher 33 over which polisher paper or other suitable material 34 is passed. The wiper 31 performs a plurality of functions, viz. wiping ink both into and out of the engraved recesses of the plate so as to leave the recesses filled to a desired level, and wiping most of the ink off the non-engraved areas of the plate. The polisher 33 removes any ink remnant from the non-engraved areas. In a conventional press, in order to remove some of the ink prior to the wiping action, an ink saving device (not shown) may be positioned clockwise of the wiper 31 relative to the plate cylinder so as to remove and save some of the ink applied prior to the wiping operation.

According to the present invention, the conventional applicator rollers for applying ink from a fountain to the plate cylinder are eliminated, and instead a pressurized ink applicator is provided for the application of ink to the plate cylinder prior to its passage under the wiper 31. In this discussion, the use of a thixotropic ink will be assumed. In FIG. 1, the nozzle 3 of an embodiment of an ink applicator according to the invention is schematically illustrated in section. The ink flows out of the nozzle 3 via exit channels or conduits 53 into exit chambers 73 formed between a series of blades 1 transversely spaced relative to the plate (i.e. circumferentially spaced relative to a cylindrical plate) and resiliently mounted in the end of the nozzle 3 so as to bear against the cylindrical surface of the cylinder 35.

It will be seen that since two exit chambers 73 are provided, a temporary flow failure in one chamber will not cause the total failure of flow of ink to the engraved recesses on the plate cylinder, because the chance that a gas or vapor bubble (or conceivably an evacuated space) will occur simultaneously in both chambers is relatively low. If necessary, however, the number of exit chambers could be increased to three or more, (simply by increasing the number of ink flow paths and blades) so as to decrease the chance that any concurrent failure of flow in all chambers would result in failure to fill any engraved areas of the plate cylinder.

Figure 5:
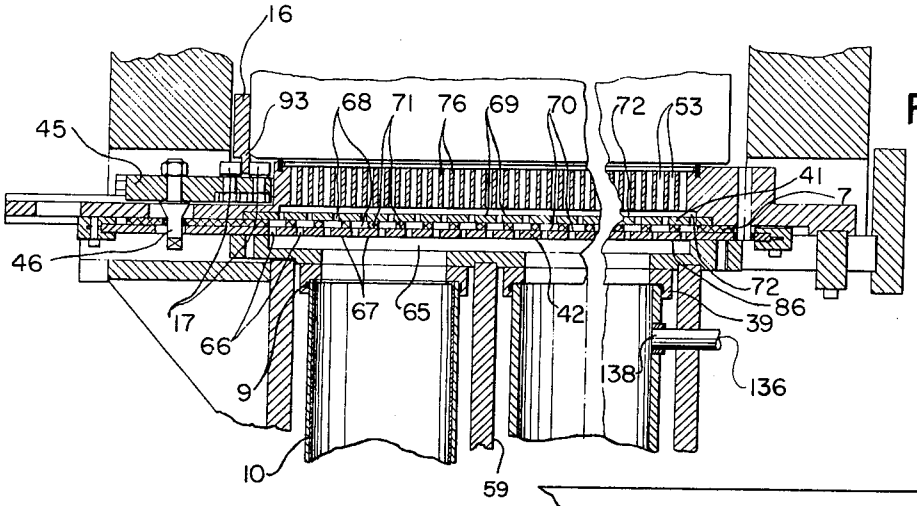
FIG. 5 is a broken plan section view of the nozzle portion of an ink applicator such as that shown in FIG. 2.
Figure 6:
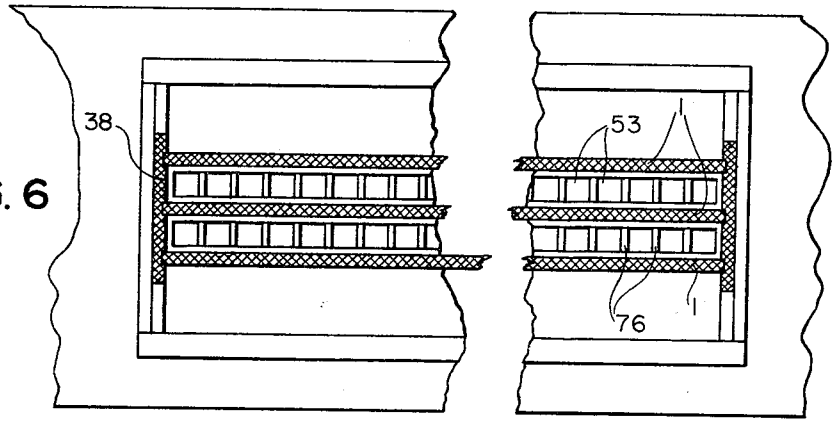
FIG. 6 is a broken front elevation schematic view of the end of the nozzle of FIG. 5.

The end structure of the nozzle 3 can best be seen from an inspection of FIGS. 5 and 6. FIG. 6 shows blades 1 spaced from one another in fixed relationship, the seal with the plate being maintained by blade end seals 38. Between the three blades are located the ink channels 53 separated from one another by spaced bars 76. The ink channels 53 and exit chambers 73 should preferably be large enough so that if there is a temporary interruption of flow at one of the exit chambers, there will still be enough flow at the other to fill the engraved recesses completely. However, the channels 53 should be small enough so that ink drag against the walls defining the channels 53 causes some shearing of the ink, thereby tending to maintain the low viscosity of the ink (which has been imparted thereto by means to be described below.)

In order that the contact of the blades with the plate cylinder be a pressure contact and yet a resilient contact, mounting pads 2 (FIG. 4) of rubber or other suitable deformable elastic material may be provided in the grooves 77 within the nozzle 3 in which the blades 1 are mounted, so that variations or irregularities in the cylindrical surface 35 may be accommodated by the compression of the resilient material 2 and the flexing (in the radial direction) across the width of the plate cylinder of the blades 1, which follow the contour of the plate. The blades 1 are made of a suitable high-impact-strength, low-friction, long-wearing material which is chemically resistant to the ink and soft enough not to cause appreciable damage to the printing plate, yet should be resistant to the abrasion of the plate cylinder. Plastic materials containing an imbedded lubricant such as high density polyethylene or polyurethane containing molybdenum disulphide, teflon, graphite or the like are suitable. The blades for example may be ⅛ inch thick, separated by small gaps, say 1/16 inch. The blades should bear against the printing plate with enough force to prevent an excess quantity of ink from flowing under the blades and being deposited on non-engraved areas.

Although some heat will necessarily be developed by the rubbing contact between blades 1 and plate cylinder 35, the heat will generally be found to improve the flow characteristics of the ink. The total heat developed by the arrangement of FIG. 1 will in most cases be found to be lower than the total heat developed by conventional inking systems, in which the transfer rollers, especially the form roller, generate substantial heat in operation.

Figure 2:
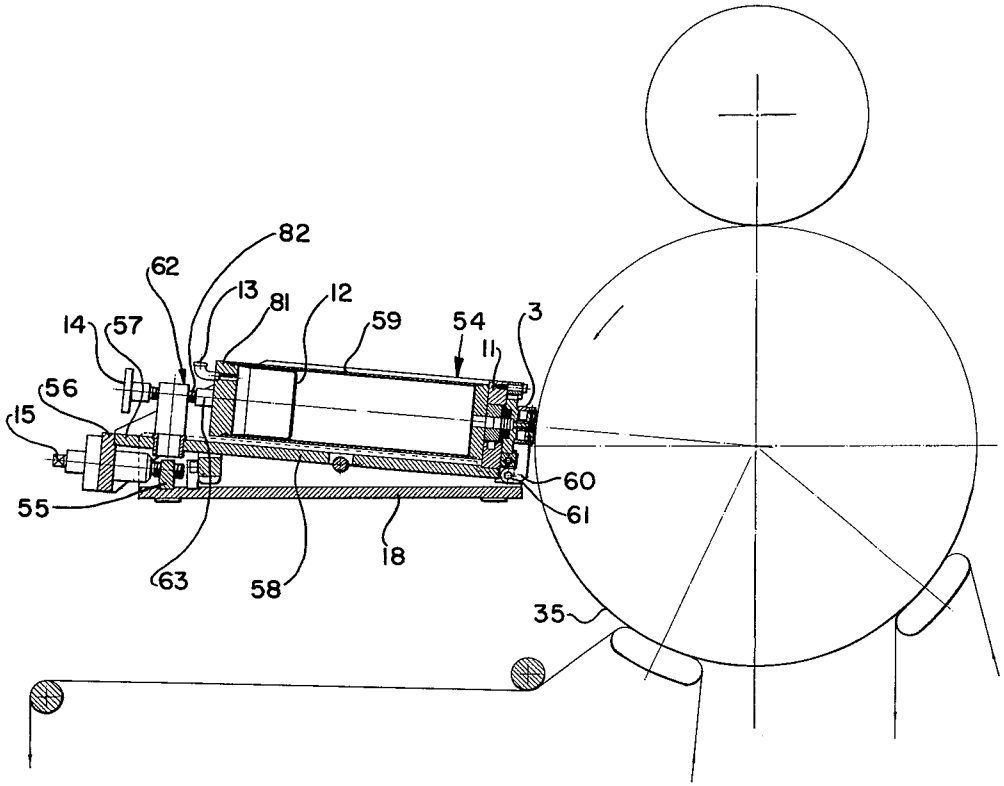
FIG. 2 is a schematic end view of an intaglio printing press showing schematically in section a preferred embodiment of the ink applicator according to the invention.

FIG. 2 shows in schematic section an elevation view of a preferred embodiment of the ink applicator under discussion. The applicator, generally identified by reference numeral 54, is mounted on a carriage 18 which can be moved towards and away from the plate cylinder 35 so that the nozzle 3 can be moved in and out of contact with the surface of plate cylinder 35. The carriage 18 is provided with rotatably mounted toothed pinions 22 (see FIG. 3) which engage gear racks 21 mounted on the frame of the press, thereby permitting movement of the applicator relative to the plate cylinder 35. This is accomplished by manual rotation of hand wheel 23 (see FIG. 3) fixed to shaft 24 journalled for rotation in the carriage 18. The shaft 24 also carries pinions 22 fixed to the shaft, so that rotation of wheel 23 moves the carriage 18 towards and away from the plate cylinder 35. The carriage 18 is provided with a locking bar 19 which engages a slot in the press frame (not shown) thereby to enable the carriage to be fixed in position with the nozzle 3 in contacting relationship with the plate cylinder 35.

Figure 10A:
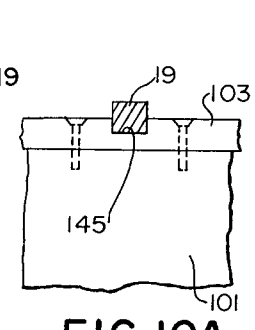
FIG. 10A is a detail view taken along line 10A—10A of FIG. 10 showing the locking bar of FIG. 10 in section and the slot which it engages so as to lock the carriage in place.
Figure 10:
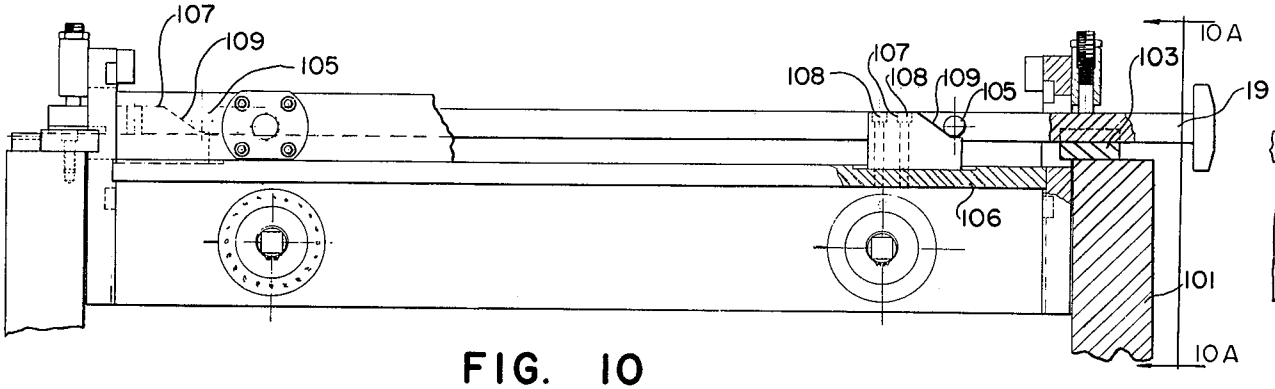
FIG. 10 is an end elevation view, partially broken and partially in section, illustrating a locking bar arrangement for use in fixing the pressurized ink nozzle carriage to the press frame in conjunction with a preferred embodiment of the present invention.

The operation of the locking bar arrangement can be more readily perceived by referring to FIGS. 10 and 10A. When the carriage is fixed in place relative to the frame, bar 19 engages a slot 145 in carrier support bars 103 which are fixed to the press side frame elements 101. The locking bar 19 is shown in this position in FIGS. 10 and 10A. If it is desired to free the carriage for movement, the bar 19 is pressed inwardly (to the left as seen in FIG. 10). Cam followers 105 fixed to and projecting horizontally from the locking bar 19 ride on cammed support blocks 107. Blocks 107 are bolted by machine bolts 108 to the carriage frame 106. As the bar 19 is pushed to the left as seen in FIG. 10, the cam followers 105 move upwardly along inclined surfaces 109 of blocks 107, thereby causing the bar 19 to lift out of the slot in carrier support bar 103, thereby freeing the carriage for travel.

Fine adjustment of the position of the nozzle 3 and of the mechanical contact pressure to be applied by the nozzle 3 against the plate cylinder 35 is obtained by rotating nozzle adjusting screw 15 (FIG. 2) which is threadedly mounted in block 55 fixed to carriage 18, the screw being provided with a bearing plate 56 which engages the end 57 of ink cylinder support plate 58 to which ink applicator 54 is fixed, thereby to adjust the pressure with which the nozzle 3 bears against cylinder 35 and to make fine position adjustment to compensate for wear of the blades 1. A mechanical contact pressure of the blades 1 against the cylinder 35 of the order of 15 psi is expected to be satisfactory. A compromise must be drawn between raising the pressure to improve doctoring of the applied ink and lowering the pressure to minimize plate cylinder and blade wear.

In FIG. 2, the nozzle 3 is shown in working position. The nozzle 3 is fixed to pivotally-connected arm 60, which is adapted to pivot about a pin 61 fixed to the carriage 18. This enables the entire nozzle assembly 25 to be pivoted (clockwise as seen in FIG. 2) away from ink containers 59 when the carriage is moved away from plate cylinder 35, thereby facilitating replacement, cleaning or maintenance of the nozzle 3 (which is normally locked in place to nozzle mounting plate 11).

Figure 3:
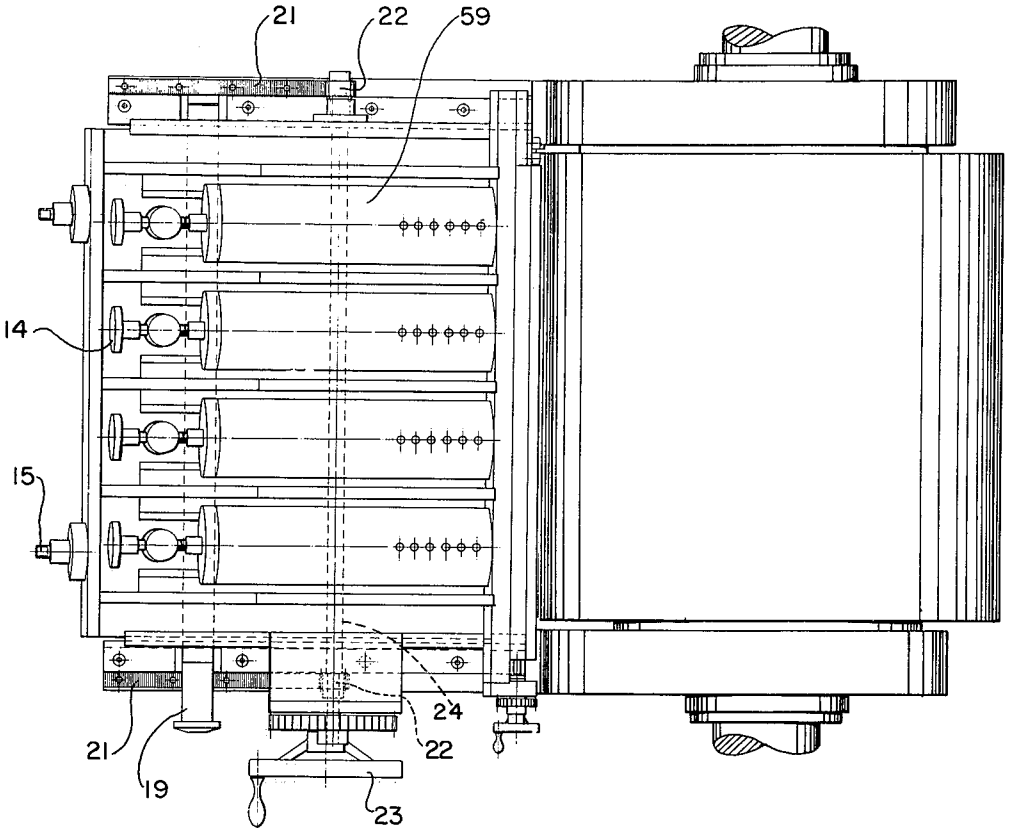
FIG. 3 is a plan view showing an ink applicator including a plurality of ink containers such as that illustrated in FIG. 2 mounted in position adjacent the plate cylinder roller of an intaglio printing press.

The ink applicator 54 includes a plurality of ink containers 59 (four being illustrated in FIG. 3). Each container 59 is mounted to the rear (to the left in FIGS. 2 and 4) of a nozzle mounting plate 11.

The ink containers can be designed in any one of several different ways. Two different designs are illustrated in part in FIG. 5. In the left-hand variant, container 59 contains a vacuum-packaged disposable, plastic or cardboard tube 10 (see FIG. 4) filled with printing ink. A piston 12 (see FIG. 2) is located in the rear portion of the container 59 and is adapted to slide within the tube 10 to exert pressure against the ink in the tube 10. Air pressure at say, 50 psi is applied to piston 12 via a compressed air inlet 13 located in closure cap 81 which engages the end of the container 59 in a press fit.

As ink is ejected from nozzle 3, the air pressure causes the forward motion of the piston 12 to occupy the space vacated by the ejected ink.

Mechanical pressure is applied to the closure cap 81 by means of a pressure block 63 rotatably mounted on the end of a screw 82 which threadedly engages a removable cylindrical clamping device 62 mounted on support plate 58. Screw 82 may be rotated by a handwheel or knob 14 fixed thereto.

In the right-hand variant of the ink container of FIG. 5, the ink container 59 is provided with an inlet port 138 to which a supply pipe 136 is connected. The supply pipe is connected to a source of ink (not shown in FIG. 5) from which ink may continually be supplied to maintain the volume of ink within container 59 substantially constant or within preset limits. (Air pressure will still be maintained on a piston (not shown in FIG. 5) to govern the force applied to the ink to eject it from the applicator.)

The forward edges of the sidewalls of the ink container 59 (or disposable cartridge) fit into a cylindrical end cap 39. An o-ring 9 maintains a seal between the end cap and the container sidewalls.

Figure 11:
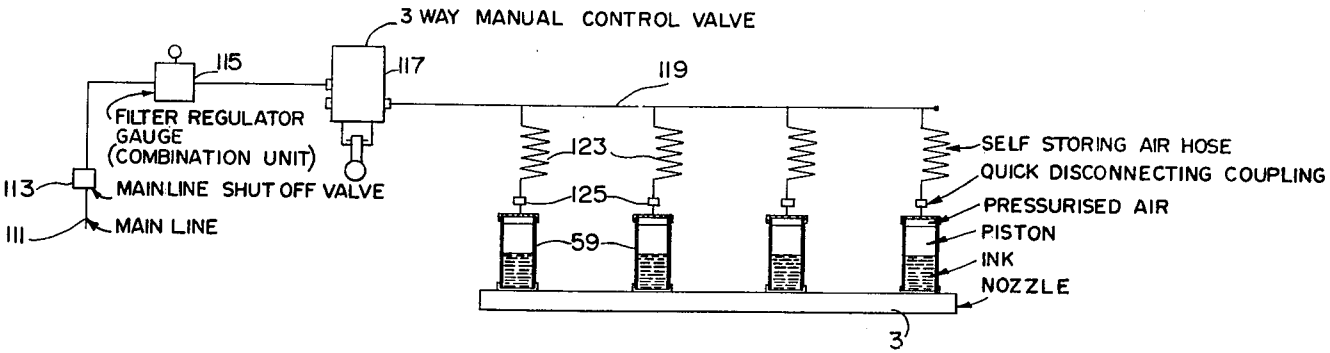
FIGS. 11 and 12 are schematic flow diagrams for alternative air pressure and ink supply systems for providing air under pressure and ink to ink containers for use in a preferred embodiment of the present invention.
Figure 12:
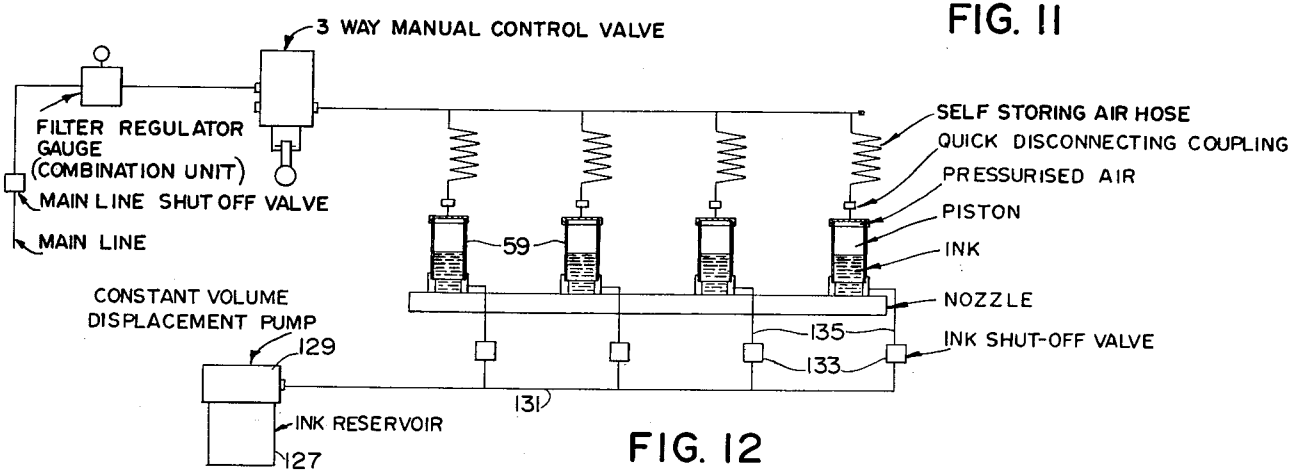

The air pressure systems for the ink containers can be best understood by referring to FIGS. 11 and 12. First referring to FIG. 11, air pressure is supplied from a main line 111 through shut-off valve 113 and pressure regulator 115 (which may include an air filter and gauge) to a manual control valve 117. From the manual control valve 117, the air passes along a trunk feeder line 119 to individual ink containers 59, which may be connected to trunk line 119 by self-storing air hoses 123 and quick disconnecting couplings 125. If cartridge-type ink containers are used, the ink containers will include a fixed quantity of ink which will eventually be exhausted through the nozzle 3.

If, however, a more permanent ink-containing arrangement is desired, that of FIG. 12 may be suitable. In the arrangement of FIG. 12, an ink reservoir 127 containing a relatively large quantity of ink is provided. Ink is pumped out of the reservoir intermittently by a constant volume displacement pump 129. The pump is connected to the individual ink containers 59 via a trunk feeder line 131, individual ink shut-off valves 133, and individual ink input supply lines 135. By this arrangement the quantity of ink is maintained within predetermined limits in the ink containers 59. Air pressure is applied to the ink in the same way as described above with reference to FIG. 11.

Figure 4:
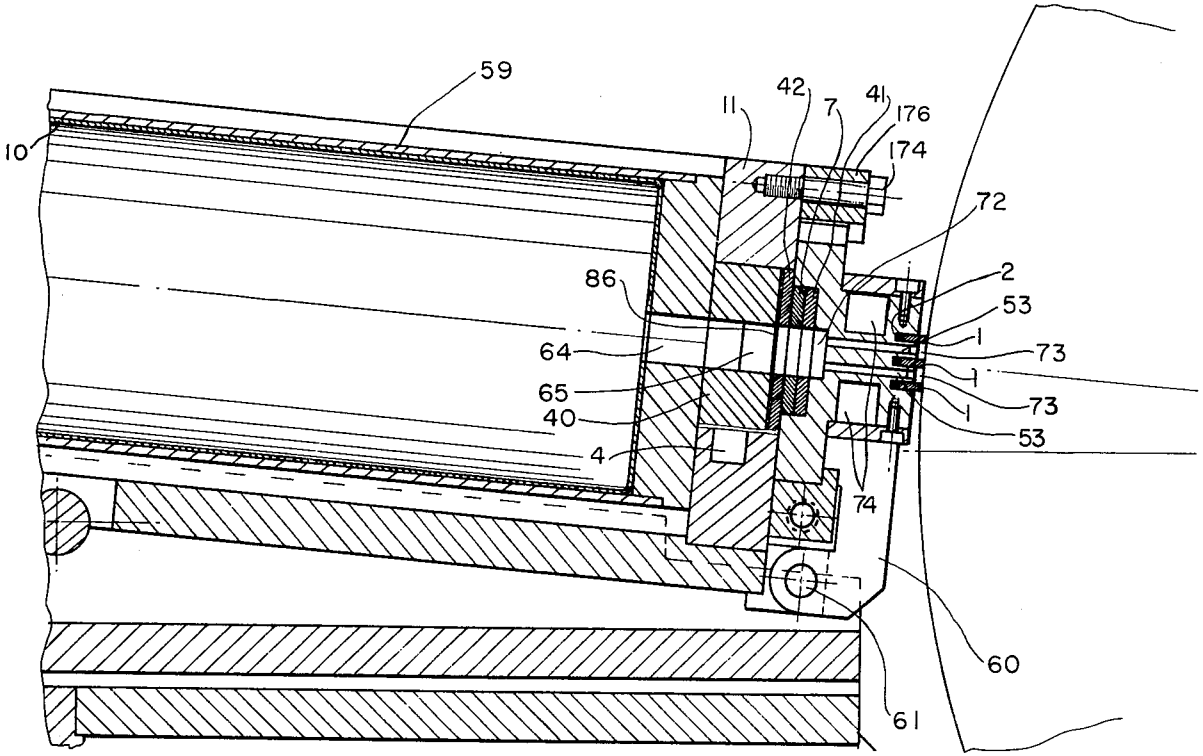
FIG. 4 is a detailed end elevation section view of the nozzle of an ink applicator such as that illustrated in FIG. 2.
Figure 7:
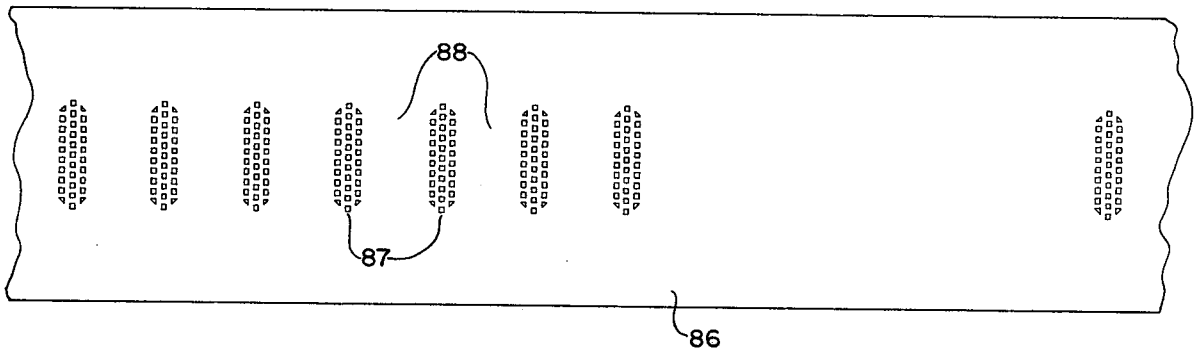
FIG. 7 is an elevation fragment view of a mechanical ink shearing element for use in the ink applicator illustrated in FIG. 5.

The path of flow of ink from each container 59 through to the nozzle 3 and into contact with plate cylinder 35 can be be perceived in greater detail by referring to FIGS. 4 and 5. A central channel 64 is provided in end cap 39, the ink flowing from left to right as seen in FIG. 4 past orifice bar 40 into a first distributing manifold 65. An energy transfer device viz. a heating element 4, may be provided adjacent each orifice in the bar 40 to impart energy to the ink thereby to improve the flow characteristics of the ink as it flows into the manifold 65. The ink then passes through a further energy transfer device, viz. mechanical shearing element 86, the structure of which is shown in end elevation view in FIG. 7, and which can be seen in that drawing to comprise a flate plate having spaced along its length a series of perforate arrays 87 separated by solid plate portions 88. The ink acquires energy as a result of its being forced under pressure through the sievelike perforations.

A slotted bar 42, as can best be seen by referring to FIG. 5, is provided with a series of regularly spaced vertical slots 66 separated by solid plate portions 67. Bar 42 and plate 86 are mounted so that perforate arrays 87 are next to slots 66, whilst solid areas 88 are next to solid areas 67. The bar 42 acts as one of two gate elements between which a sliding valve 7 reciprocates, the other gate element being valve back-up bar 41 which is likewise provided with a plurality of vertical regularly spaced slots 68 separated by solid plate portions 69. It can be seen that slots 66 are horizontally off-set from slots 68. The valve 7 is provided with vertical gaps 70 wider than the gaps 68 and 66 located in the plates 41 and 42 and between which are located solid valve portions 71. The sliding action of the valve 7 will be further explained below; for the present it is sufficient to observe that when valve 7 is in the position shown in FIG. 5, ink can flow from distributing manifold 65 through element 86, slots 66, valve openings 70, and slots 68 into a collecting manifold 72. From manifold 72 the ink flows through channels 53 as described previously with reference to FIG. 1. The spacing between blades 1 is chosen to be wider than each channel 53 so that exit chambers 73 formed between the blades 1 function as collecting manifolds immediately adjacent the surface of plate cylinder 35, thus tending to ensure the filling of the engraved channels on the printing plate. Further heating elements 74 (FIG. 4) may be provided adjacent channels 53 in the nozzle 3 in order to maintain a satisfactorily low viscosity of the ink as it flows through channels 53.

The mechanism for actuating valve 7 will now be described.

Figure 8B:
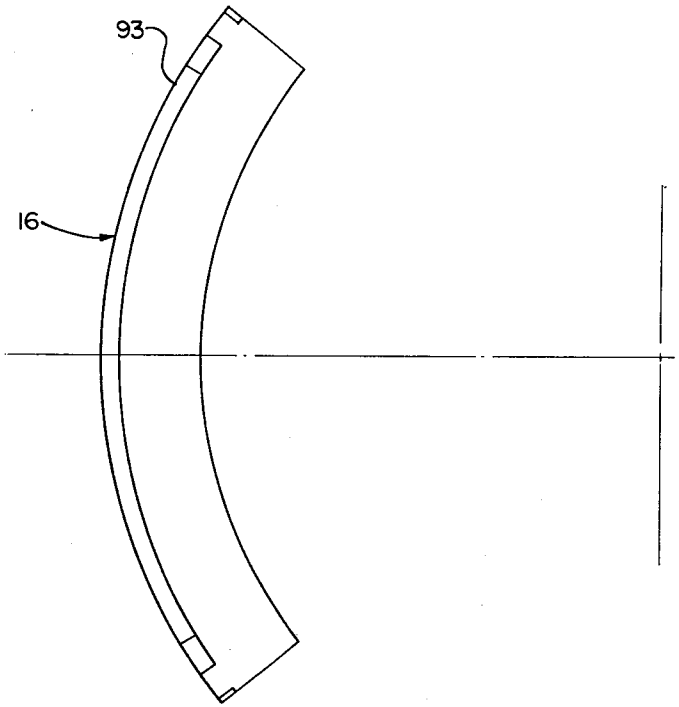
FIG. 8*a* is an end view and FIG. 8*b* is a side elevation view of a cam for use in controlling the valve illustrated in the ink applicator of FIG. 5.
Figure 8A:
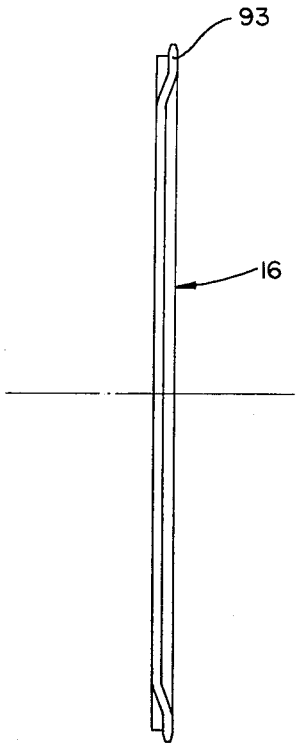

Affixed to the plate cylinder 35 is a cam element 16 (see FIGS. 5, 8*a* and 8*b*) against which spaced cam followers 17, fixed to valve actuator slide 45, bear. Cam followers 17 engage opposite sides of camming rib 93 of cam element 16. In the position of the valve shown in FIG. 5, the camming rib 93 is shown as being in the extreme right position. As the cam 16 rotates with the cylinder 35, however, the camming rib 93 will at the appropriate time move to the left (as seen in FIG. 5). As the rib 93 moves to the left, cam followers 17 follow, forcing valve actuator slide 45 and valve actuator pin 46 mounted in the slide 45 also to the left. The pin 46, which passes through sliding valve element 7, forces element 7 also to move to the left. As a result, the solid portions 71 of the valve element 7 will assume a blocking position between gaps 68 and 66 to prevent flow of ink from accumulating chamber 65 into chamber 72. The arcuate portion of the cam 16 occupied by the "right hand position" of the cam is chosen to coincide more or less with that portion of the plate cylinder which bears the image, whilst the "left hand portion" of the cam is chosen to coincide more or less with a non-image area of the plate cylinder so that ink will flow only at the times that an image appears beneath the nozzle 3. Since there is a certain amount of inertia and drag in the ink flow from manifold 65 to the exit chambers 73, the initial and terminating positions of the cam relative to the plate cylinder can be slightly offset from the image areas so that valve action is set to precede the actual appearance of image or non-image areas under the nozzle 3.

Figure 9:
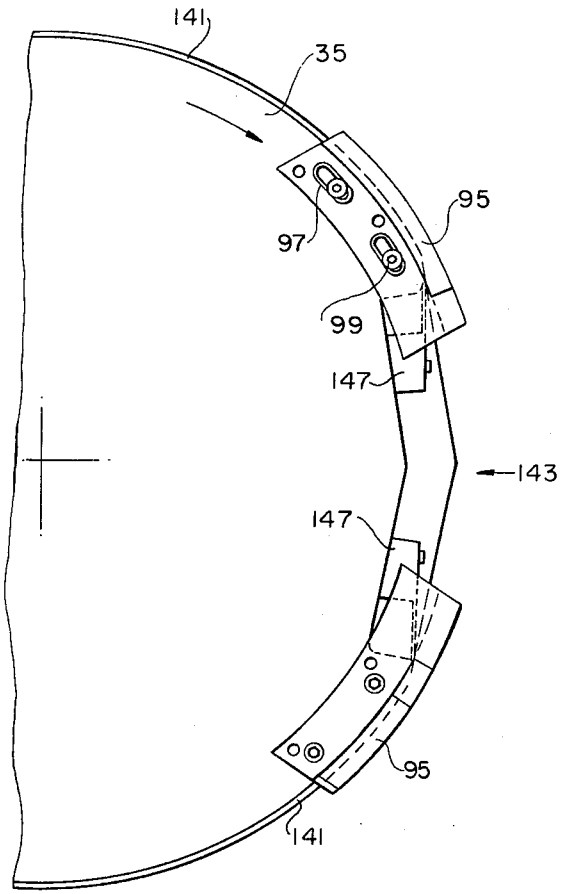
FIG. 9 is an end elevation view of an alternative, split cam, arrangement for use as a valve control cam for the valve of FIG. 5.

If desired, the cam 16 can be split into two or more segments so as to permit adjustment of the position at which the sliding valve operates. FIG. 9 illustrates this possibility, showing separate cam segments 95 fixed to the plate cylinder 35. At least one of the segments is provided with circumferentially extending slots 97 through which bolts 99 engaging threaded bores in cylinder 35 pass, the bolts furnishing capability for circumferential adjustment of the cam segments 95.

FIG. 9 also illustrates in greater detail the most common version of rotary intaglio printing cylinder, viz. a plate cylinder upon which a printing plate 141 is mounted by means of clamping elements 147. This type of printing cylinder requires that there be a substantial gap or non-image area 143 in the vicinity of the clamped ends of the plate 141, and for this arrangement the use of a valve arrangement to cut off ink flow while the non-image area is underneath the ink applicator is especially useful.

It will be noted from the above discussion that manifolds are provided to minimize the possibility of occurrence of gas or vapor bubbles in the ink flow path. These manifolds are, with one exception mentioned below, located immediately before constrictions in the ink flow path. Manifold 65 for example, is provided immediately before ink-shearing element 86 and the gate and valve openings adjacent thereto. Manifold 72 is provided intermediate the passage of ink from the exit gate 41 into nozzle conduits 53. Finally, the exception is the provision of the ink exit chambers 73 formed between blades 1 when the blades are in contact with the plate cylinder 35. These chambers 73 function as collecting manifolds and tend to ensure that enough ink is available between the blades to fill the engraved recesses on the printing plate.

Figure 13:
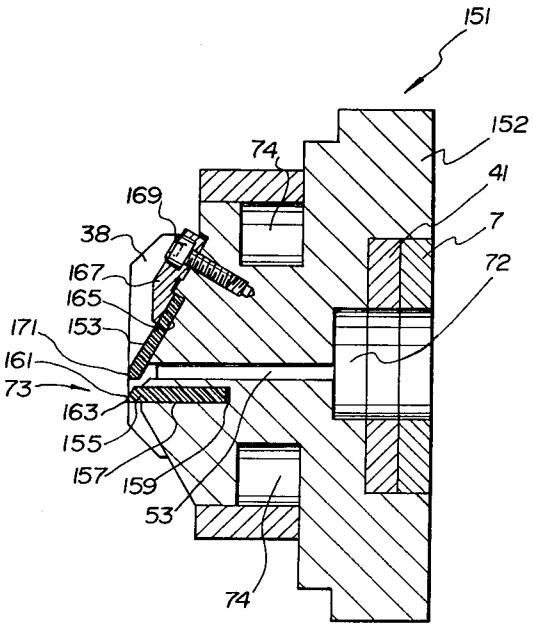
FIG. 13 is a side elevation section view of an alternative embodiment of a nozzle for an ink applicator in accordance with the invention.

FIG. 13 illustrates a side elevation section view of an alternative nozzle structure for use in accordance with the teachings of this invention. The nozzle structure, generally indicated as 151, is provided with only a single ink channel 53 leading from manifold 72 to the exit chamber 73 located between two transversely extending blades 153, 155. The nozzle 151 can be mounted in the assembly illustrated in FIG. 4 by means of the removable bolts 174 and associated clamping elements 176 shown in those Figures.

The lower blade 155 is retained in a snug fit in recess 157 at the inner extremity of which is located a resilient elastomeric pad 159. The blade 155 is provided at its free end with a downwardly outwardly sloping surface 161. The outermost flat tip 163 of the blade 155 sealingly contacts the printing surface when the nozzle 151 is operationally mounted in the printing press. The sloping surface 161 facilitates an accumulation of ink on the printing surface and thus complete fill of the engraved recesses prior to the doctoring of the ink from the printing surface by the trailing blade 155.

The upper leading blade 153 is mounted against a sloping surface 165 of the nozzle body 152 by means of a clamp 167 and a plurality of clamping bolts 169 threadedly engaging the body 152. In operation, the free end 171 of the blade 173 preferably makes a light pressure contact with the printing surface for the purpose of sealing the nozzle exit region 73. If the speed of movement of the printing surface past the nozzle 151 is sufficiently rapid, it is possible that the free end 171 of blade 153 could be separated from the printing surface by a very slight clearance, because the combined effect of the rapid relative motion and the very small clearance between the blade 153 and the printing surface might prevent the flow of ink around the free end 171 of the blade 153. However, to be on the safe side, an actual sealing contact of the blade 153 with the printing surface is preferred.

Each of the blades 153, 155 may be made of a hard strong plastic material for long life and minimum wearing of the printing surface, and can suitably be about an $\frac{1}{8}$ in. thick and can be separated from one another by about 0.030 to 0.060 in. The slope of the surface 161 of blade 155 can be at about 20° to the vertical (it being assumed that the tangent to the printing surface is vertical). The mechanical force with which the lower trailing blade 155 engages the printing surface should be fairly high (see the discussion above with reference to the nozzle described in FIGS. 4, 5 and 6) in order to minimize ink scum on the printing surface and to ensure that the ink at nozzle exit chamber 73 is maintained under sufficient pressure to fill completely the engraved recesses of the printing surface. However, as indicated above, the upper blade 153 may contact the printing surface with a lighter force, the engagement of the blade 153 with the printing surface merely being sufficient to prevent ink from oozing out between the free end 171 of blade 153 and the printing surface.

Figure 15:
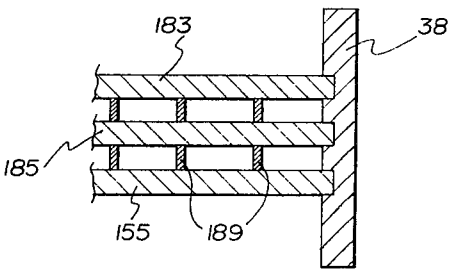
FIG. 15 is a fragmentary front elevation view of the nozzle exit of FIG. 14.
Figure 14:
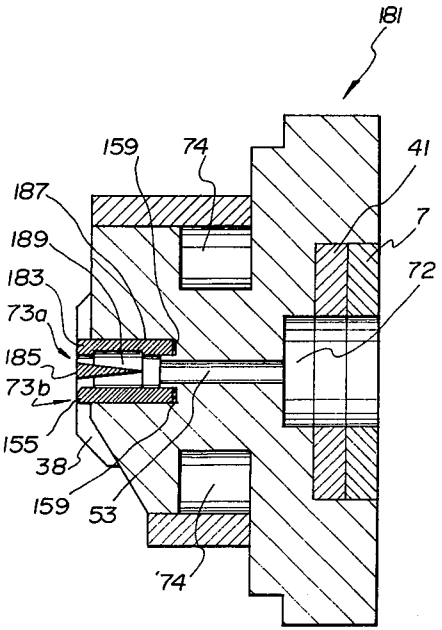
FIG. 14 is a side elevation section view of a further alternative embodiment of a nozzle for an ink applicator in accordance with the invention.

FIG. 14 illustrates, in side elevation section view, a modified version 181 of the nozzle of FIG. 13. In this case, the nozzle configuration is the same except that the inclined blade 153 is replaced by two spaced plastic blades 183, 185 which provide two ink exit chambers **73*a*, 73*b* for the nozzle 181. The uppermost blade 183 is provided with a resilient elastomeric pad 159 located in the slotted recess 187 into which the blade 183 snugly fits. The centremost blade 185 is preferably wedge-shaped, with the broad face of the wedge at the exit and the converging surfaces projecting inwardly into the ink channel 53. The wedge surfaces enable the hydraulic load of the ink flow through the ink channel 53 to exert outward pressure on the blade 185 tending to maintain it in contact with the printing surface. The blade 185 is maintained in accurate vertical spacing relative to blades 183 and 155 by means of spacer elements 189 (see also FIG. 15**). The three-blade configuration enables the principle of redundancy to be applied to ensure that the ink-receiving engraved recesses of the printing surface are completely filled.

Figure 18:
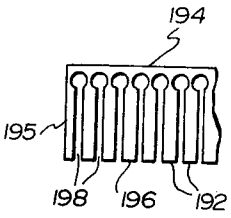
FIG. 18 is a fragmentary detail plan view of a blade for use in the embodiment depicted in FIG. 16.
Figure 17:
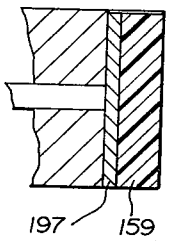
FIG. 17 is a fragmentary detail view, in section of blade and blade support elements for use in the embodiment depicted in FIG. 16.
Figure 17:
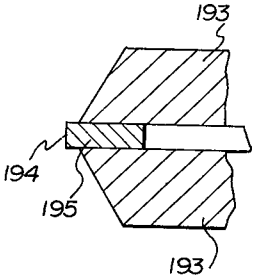
Figure 16:
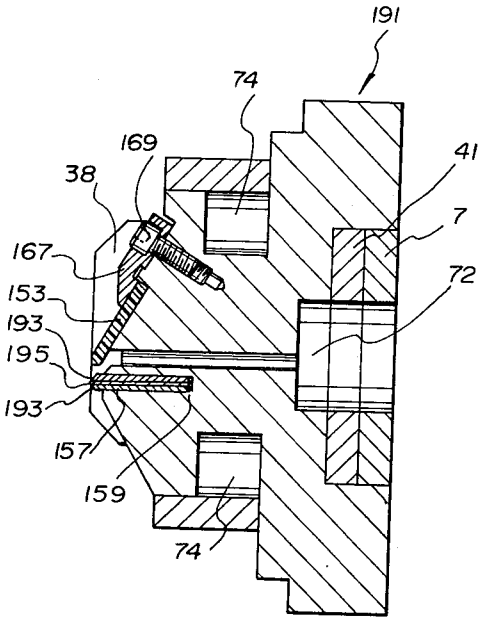
FIG. 16 is a side elevation section view of a further alternative embodiment of a nozzle for an ink applicator in accordance with the invention.

Although the plastic blade configurations heretofore described are satisfactory for the purposes indicated, nevertheless in order to reduce the amount of ink scum on the printing surface, a metal doctor blade serving as the trailing blade may be substituted for the plastic trailing blade. A nozzle configuration otherwise identical to that of FIG. 13 but in which a metal doctor blade 195 is substituted for the plastic doctor blade 155 is illustrated in FIG. 16. The metal blade 195, as more clearly illustrated in FIG. 18, is preferably of comb-like steel or beryllium-copper alloy structure having a printing-surface-contacting face 194 and a plurality of spaced supporting strips 192 separated by spaces 198. The blade 195 is mounted between two blade support elements 193, also preferably made of steel. The innermost end 196 of the blade 195 and the innermost ends of the blade support elements 193 contact a spring steel plate 197 which in turn bears against elastomeric pad 159. The elements 193 and 195 together snugly fit in nozzle body slot 157.

The blade 195 can preferably be about 0.020 in. thick. The contacting face 194 of blade 195 should project outwardly beyond the outermost ends of blade support elements 193 by about 0.010 in. but preferably not appreciably more than this amount. The comb-like structure and thin section of the blade 195 enable it to accommodate surface irregularities in the printing surface so as to tend to minimize wear of the printing surface by the blade contact. On the other hand, the effective stiffness of the blade 195 for doctoring purposes is maintained by the blade support elements 193.

Figure 19:
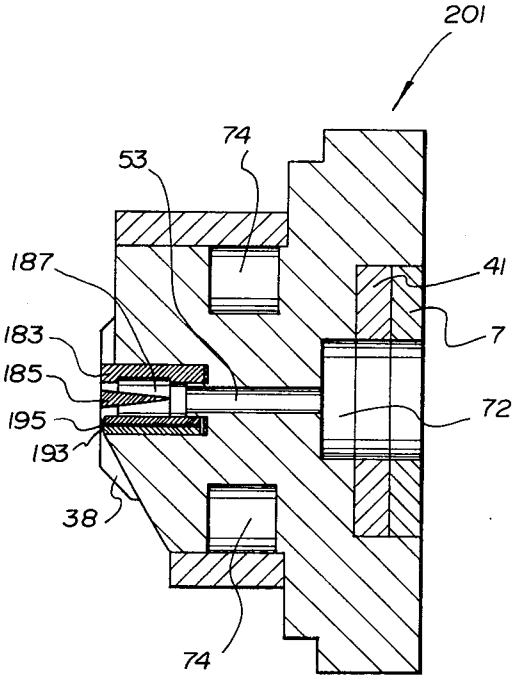
FIG. 19 is a side elevation section view of a further alternative embodiment of a nozzle for an ink applicator in accordance with the invention.

FIG. 19 illustrates in side elevational sectional view a nozzle 201 substantially identical to the nozzle 181 of FIG. 14 with the exception that the lower blade 155 is replaced by a blade 195 and blade support elements 193 as described with reference to FIG. 16. The FIG. 19 variation permits the principle of ink exit redundancy to be used to ensure complete filling of the engraved recesses of the printing surface.

Figure 21:
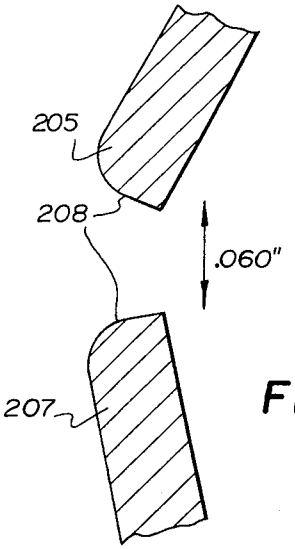
FIG. 21 is a fragmentary detail side elevation view of the ends of the blades of the embodiment of FIG. 20.
Figure 22:
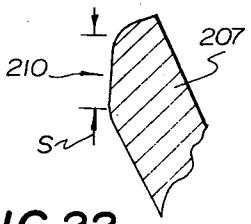
FIG. 22 is a fragmentary detail side elevation view of an alternative version of a trailing blade for use in the embodiment of FIG. 20.
Figure 20:
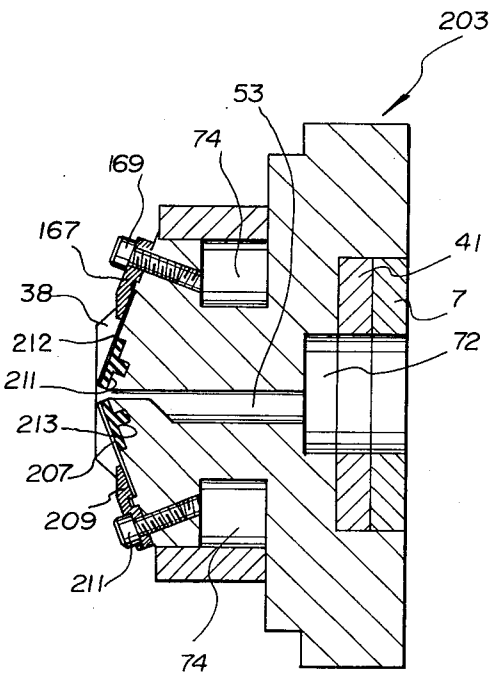
FIG. 20 is a side elevation section view of a further alternative embodiment of a nozzle for an ink applicator in accordance with the invention.

FIG. 20 illustrates in side elevation section view a further nozzle embodiment 203 in which two nozzle blades 205, 207 are shown mounted at an angle to the vertical (it being assumed that the tangent to the printing surface is vertical). The upper blade 205 may be made of spring steel of 0.020 in. thickness and is clamped in place by clamping element 167 and bolt 169 in the same manner as discussed previously with reference to FIG. 13. The lower blade 207 may be of essentially the same dimensions as the blade 205 and of the same material and is clamped by a similar clamping element 209 and associated bolt 211. Resilient elastomeric pads 212, 213 are provided against which the blades 205, 207 may deflect to a limited amount to accommodate irregularities in the printing surface. The blades 205 and 207, as more clearly illustrated in FIG. 21 are separated from one another by a small gap of the order of 0.040–0.060 in. and the contacting edges of the blades are preferably rounded, as indicated by reference numeral 208, to minimize wear of the printing surface. It will be appreciated that over a period of time the rounded edges will tend to be flattened off, but in any event the curvature tends to facilitate the deflection of the blades 205, 207 against the resilient force exerted by pads 211 and 213 whenever a surface irregularity strikes either of the blades. Indeed, it may be preferable to generate an initial flattening of at least the lower blade 207, as indicated by flattened area 210 in FIG. 22, in order to prevent the possibility of ink flow around the end of blade 207 when the blade 207 is engaging a transversely oriented engraved recess. The flattened portion 210 over distance S should thus be wider than the widest transverse engraved recess to be expected on the printing surface.

It will be apparent that a centrally located wedge-shaped third blade located between blades 205, 207 could optionally be provided if desired, along the general lines of the teachings given above with reference to FIGS. 14 and 19.

It will be observed that the structures of FIGS. 13 to 20 enable relatively easy blade replacement, and in some cases the blades can be re-used merely by reversing the blades in their nozzle positions to present a fresh edge to the printing surface.

Variants in the elements of the ink applicators described above will readily occur to those skilled in the art. For example, the blades 1 could be spring-loaded instead of mounted against a resilient elastomeric material. A valve arrangement other than the sliding valve described could be chosen, although any valve which must bear the ink flow pressure should preferably not be chosen. A suitable valve should not, when operated, cause any significant movement of ink along its flow path. Rotating-type valves, however, could be chosen which would not be subjected directly to the ink load. Other variants may occur to those persons wishing to practise the invention without detracting from the general principles of the invention.

What I claim is:

1. A stiff bodied ink applicator for an intaglio security printing press having a printing surface having a plurality of engraved recesses defining an image, comprising: a nozzle for applying ink to the engraved recesses of the printing surface and for doctoring applied ink from the non-engraved areas of the printing surface, means for removably mounting the nozzle in contact with the printing surface, conduit means connecting the nozzle to a source of ink under pressure, said nozzle including at least two transversely extending blades and means biasing an edge of each said blade towards the printing surface whereby the nozzle sealingly contacts the printing surface, one of said blades defining the trailing edge of said nozzle for doctoring applied ink from the nonengraved areas of the printing surface, energy transfer means associated with said conduit means for imparting energy to the ink whereby the flow characteristics of the ink are improved before application of the ink to the printing surface, a cam moving with the printing surface, follower means cooperating with the cam, and a sliding valve slidably mounted within the applicator transverse to the ink flow path through said conduit means and controlled by the follower means and effective to impede the flow of ink through the conduit means in at least one position of the follower means.

2. An ink applicator as defined in claim 1, wherein the sliding valve moves between two gates having relatively offset openings, the sliding valve being provided with gaps adapted to overlap said openings of both said gates when the valve is open, and being provided with solid portions between said gaps to close off the space between the gate openings when the valve is closed, in response to motion of the follower.

3. For use with a rotary press, an ink applicator as defined in claim 2 wherein the said one position of the cam is chosen to coincide with the passage of a non-image area of the plate cylinder of the press adjacent the nozzle.

4. A stiff bodied ink applicator for an intaglio security printing press having a printing surface having a plurality of engraved recesses defining an image, comprising: a nozzle for applying ink to the engraved recesses of the printing surface and for doctoring applied ink from the non-engraved areas of the printing surface, means for removably mounting the nozzle in contact with the printing surface, conduit means connecting the nozzle to a source of ink under pressure, said nozzle including at least two transversely extending blades and means biasing an edge of each said blade towards the printing surface whereby the nozzle sealingly contacts the printing surface, one of said blades defining the trailing edge of said nozzle for doctoring applied ink from the non-engraved areas of the printing surface, energy transfer means associated with said conduit means for imparting energy to the ink whereby the flow characteristics of the ink are improved before application of the ink to the printing surface, said conduit means including ink shearing means comprising multiple parallel restricted openings for ink flow, and a distributing manifold located immediately upstream from said openings, a cam moving with the printing surface, follower means cooperating with the cam, and a sliding valve slidably mounted within the applicator transverse to the ink flow path through said conduit means and controlled by the follower means and effective to impede the flow of ink through the conduit means in at least one position of the follower means.

5. An ink applicator as defined in claim 4, wherein the sliding valve moves between two gates having relatively offset openings, the sliding valve being provided with gaps adapted to overlap said openings of both said gates when the valve is open, and being provided with solid portions between said gaps to close off the space between the gate openings when the valve is closed, in response to motion of the follower.

6. For use with a rotary intaglio press, an applicator as defined in claim 5, wherein the said one position of the cam is chosen to coincide with the passage of a non-image area of the plate cylinder of the press adjacent the nozzle.

7. A stiff bodied ink applicator for an intaglio security printing press having a printing surface having a plurality of engraved recesses defining an image, comprising: a nozzle for applying ink to the engraved recesses of the printing surface and for doctoring applied ink from the non-engraved areas of the printing surface, means for removably mounting the nozzle in contact with the printing surface, conduit means connecting the nozzle to a source of ink under pressure, said nozzle including at least two transversely extending blades and means biasing an edge of each said blade towards the printing surface whereby the nozzle sealingly contacts the printing surface, one of said blades defining the trailing edge of said nozzle for doctoring applied ink from the non-engraved areas of the printing surface, and energy transfer means associated with said conduit means for imparting energy to the ink whereby the flow characteristics of the ink are improved before application of the ink to the printing surface, said one blade being of thin comb-like construction and having its ink doctoring edge flexible to accommodate surface irregularities and surface variations of said printing surface, said one blade being mounted in the nozzle between a pair of transversely-extending blade support elements which support the blade to within a very short distance from the ink-doctoring edge thereof.

8. A stiff bodied ink applicator for an intaglio security printing press having a printing surface having a plurality of engraved recesses defining an image, comprising: a nozzle for applying ink to the engraved recesses of the printing surface and for doctoring applied ink from the non-engraved areas of the printing surface, means for removably mounting the nozzle in contact with the printing surface, conduit means connecting the nozzle to a source of ink under pressure, said nozzle including at least two transversely extending blades and means biasing an edge of each said blade towards the printing surface whereby the nozzle sealingly contacts the printing surface, one of said blades defining the trailing edge of said nozzle for doctoring applied ink from the non-engraved areas of the printing surface, and energy transfer means associated with said conduit means for imparting energy to the ink whereby the flow characteristics of the ink are improved before application of the ink to the printing surface, said biasing means including resilient pad means permitting the blades to deflect slightly to accommodate variations in the printing surface, said one blade being inclined inwardly away from its line of contact with the printing surface, at an acute angle to the hypothetical plane surface tangent to the printing surface at said line of contact, the resilient pad means for the trailing blade extending transversely parallel and adjacent to the trailing blade on the other side of that surface of the trailing blade which is in the vicinity of said line of contact.

9. An ink applicator as defined in claim 8, wherein the leading blade and trailing blade and their associated resilient means are mounted in the nozzle symmetrically about the conduit means.

10. A stiff-bodied ink applicator for an intaglio printing press having a printing surface having a plurality of engraved recesses defining an image, comprising: a nozzle for applying ink to the engraved recesses of the printing surface and for doctoring the applied ink from the printing surface, means for removably mounting the nozzle in contact with the printing surface, conduit means connecting the nozzle to a source of ink under pressure, said nozzle being provided with at least three transversely extending blades each having an edge adapted to contact the printing surface along the length of the nozzle, one of said blades defining the trailing edge of said nozzle, said blades dividing the end of the nozzle transversely relative to the printing surface into at least two ink-depositing regions receiving ink from separate conduits of said conduit means, each of the ink-depositing regions being defined by two of said blades, the blades being adapted to maintain a tight seal between the nozzle and the printing surface, and energy transfer means associated with said conduit means for imparting energy to the ink whereby the flow characteristics of the ink are improved before application of the ink to the printing surface, said energy transfer means being associated with each of said last-mentioned conduits, at least one of said blades located between the leading blade and the trailing blade being wedge-shaped and mounted in the nozzle for limited motion towards the printing surface, the wedge surfaces of the wedge-shaped blade converging inwardly into the interior of the nozzle, whereby the hydraulic load of ink against at least one of the wedge surfaces tends to force the wedge-shaped blade into contact with the printing surface.

11. Ink applicator apparatus for an intaglio security printing press having a printing surface with spaced, ink-receiving recesses in said surface, at least some of the recesses being elongated to print lines, comprising:

a. a nozzle (3);
b. means (15,18) supporting the nozzle in sealing engagement with the printing surface;
c. means (35) for relatively moving the surface and the nozzle while maintaining said sealing engagement;
d. a reservoir (59) of viscous ink;
e. means (54) for feeding ink directly from the reservoir substantially only to the recesses, with minimal overflow and with minimal deposit of ink on the surface between the recesses, said ink feeding means comprising:
   1. said nozzle (3), including:
      a. at least two blades (1) extending transversely of the direction of relative movement of the printing surface;
      b. end seal means (38) spanning the blades at the ends thereof;
   2. means (111,115,117,119,123,125) for maintaining said reservoir under substantially constant pressure; and 3. conduit means (64,40,65,66,70,68,72,53,73) for conveying all the ink discharged from the reservior directly to the nozzle; and f. said supporting means including means (21,22,23,24) to adjust the position of the nozzle so that ink moves from the reservior directly to the nozzle and escapes from the nozzle substantially only by entering the recesses in the surface.

12. Apparatus as in claim 11, including an exit chamber (73) between the two blades and extending lengthwise of the nozzle, the only outlet from said exit chamber being provided by the passing recesses in the printing surface.

13. Ink applicator apparatus for an intaglio security printing press having a printing surface with spaced, ink-receiving recesses in said surface, at least some of the recesses being elongated to print lines, comprising:

a. a nozzle (3);

b. means (15,18) supporting the nozzle in sealing engagement with the printing surface;

c. means (35) for relatively moving the surface and nozzle while maintaining said sealing engagement;

d. a reservoir (59) of viscous ink;

e. means (54) for feeding ink directly from the reservior substantially only to the recesses, with minimal overflow and with minimal deposit of ink on the surface between the recesses, said ink feeding means comprising:

1. said nozzle (3), including:

a. at least two blades (1) extending transversely of the direction of relative movement of the printing surface;

b. end seal means (38) spanning the blades at the ends thereof;

c. an exit chamber (73) between the two blades and extending lengthwise of the nozzle, the only outlet from said exit chamber being provided by the passing recesses in the printing surface; and d. a multiplicity of short, parallel channels (53) supplying ink to said exit chamber;

2. means (111,115,117,119,123,125) for maintaining said reservoir under substantially constant pressure; and 3. conduit means (64,40,65,66,70,68,72,53,73) for conveying all the ink discharged from the reservoir directly to the nozzle; and f. said supporting means including means (2,21,22,23,24) to adjust the position of the nozzle so that ink moves from the reservoir directly to the nozzle and escapes from the nozzle substantially only by entering the recesses in the surface.

14. Apparatus as in claim 13, including a common manifold (72) feeding said multiple channels.

15. Apparatus as in claim 14, including a plurality of reservoirs (59) feeding said common manifold at spaced points.

16. Apparatus as in claim 15, in which said pressure maintaining means includes means (111,115,117,119) for maintaining the pressure in all of the reservoirs substantially equal and substantially constant.

17. Apparatus as in claim 11, including means in said conduit means for shearing the viscous ink flow therethrough, said shearing means including a flat plate extending transversely of the direction of flow and having an array of holes therein for producing multiple parallel streams of ink.

18. Apparatus as in claim 17, in which said ink shearing means includes a distributing manifold upstream from the plate and a collecting manifold downstream from the plate.

19. Apparatus as in claim 18, in which said shearing means includes a flat gate valve plate sliding between two stationary flat plates, all said plates extending transversely to the direction of flow.

20. Apparatus as in claim 11, in which the ink feeding means beginning at the reservoir and continuing to and including the nozzle is closed so that all the ink leaving the reservoir is discharged from the nozzle.

21. Apparatus as in claim 20, in which:

a. said reservoir is cylindrical and has a discharge opening at one end;

b. a piston in said reservoir acts to force the ink through the discharge opening, said piston being subject to an actuating fluid pressure on the opposite face thereof from the ink.

* * * * *